US008624803B2

(12) United States Patent
Childs et al.

(10) Patent No.: US 8,624,803 B2
(45) Date of Patent: Jan. 7, 2014

(54) ELECTROLUMINESCENT DISPLAY DEVICE HAVING PIXELS WITH NMOS TRANSISTORS

(75) Inventors: Mark J. Childs, Sutton (GB); David A. Fish, Haywards Heath (GB); Jason R. Hector, Redhill (GB)

(73) Assignee: Koninklijke Philips N.V., Eindhoven (NL)

( * ) Notice: Subject to any disclaimer, the term of this patent is extended or adjusted under 35 U.S.C. 154(b) by 1769 days.

(21) Appl. No.: 10/523,379

(22) PCT Filed: Jul. 22, 2003

(86) PCT No.: PCT/IB03/03202

§ 371 (c)(1), (2), (4) Date: Dec. 14, 2005

(87) PCT Pub. No.: WO2004/015667

PCT Pub. Date: Feb. 19, 2004

(65) Prior Publication Data

US 2006/0113919 A1 Jun. 1, 2006

(30) Foreign Application Priority Data

Aug. 6, 2002 (GB) ..... 0218170.9

(51) Int. Cl.
*G09G 3/30* (2006.01)

(52) U.S. Cl.
USPC ..... 345/77; 345/76

(58) Field of Classification Search
USPC ..... 315/169.1–169.4; 345/76–83, 204–215, 345/690–699
See application file for complete search history.

(56) References Cited

U.S. PATENT DOCUMENTS

| | | | | |
|---|---|---|---|---|
| 6,548,960 | B2 * | 4/2003 | Inukai | 315/169.3 |
| 6,734,636 | B2 * | 5/2004 | Sanford et al. | 315/169.3 |
| 6,809,706 | B2 * | 10/2004 | Shimoda | 345/55 |
| 7,623,098 | B2 * | 11/2009 | Yamazaki et al. | 345/77 |
| 2001/0002703 | A1 * | 6/2001 | Koyama | 257/40 |
| 2001/0019327 | A1 * | 9/2001 | Kim et al. | 345/204 |
| 2002/0105040 | A1 * | 8/2002 | Yamazaki et al. | 257/408 |
| 2002/0113760 | A1 * | 8/2002 | Kimura | 345/82 |
| 2002/0180671 | A1 * | 12/2002 | Inukai | 345/76 |
| 2003/0030382 | A1 * | 2/2003 | Koyama | 315/169.1 |
| 2003/0030603 | A1 * | 2/2003 | Shimoda | 345/76 |
| 2003/0095087 | A1 * | 5/2003 | Libsch et al. | 345/82 |
| 2003/0111964 | A1 * | 6/2003 | Childs | 315/169.1 |
| 2003/0146912 | A1 * | 8/2003 | Sung et al. | 345/212 |
| 2004/0100430 | A1 * | 5/2004 | Fruehauf | 345/82 |
| 2004/0227709 | A1 * | 11/2004 | Lih et al. | 345/82 |

* cited by examiner

*Primary Examiner* — Alexander Eisen
*Assistant Examiner* — Patrick F Marinelli

(57) ABSTRACT

An active matrix electroluminescent display device has pixels using an amorphous silicon or microcrystalline silicon drive NMOS transistor (22) connected between the anode of the display element (2) and a power supply line (26). A storage capacitor (24) is connected between the anode of the display element and the gate of the drive transistor (22). An amorphous silicon or microcrystalline silicon second drive NMOS transistor (30) supplies a holding voltage to the anode of the display element (2). This arrangement enables the voltage across the display element to be held while the transistor gate drive voltage is stored on the storage capacitor. This enables an accurate current source pixel circuit to be implemented using NMOS transistors.

16 Claims, 2 Drawing Sheets

ELECTROLUMINESCENT DISPLAY DEVICE HAVING PIXELS WITH NMOS TRANSISTORS

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase. However, different transistor characteristics across the substrate give rise to different relationships between the gate voltage and the source-drain current, and artefacts in the displayed image result.

The very low mobility of electrons and the variation of threshold voltages with time has prohibited the use of amorphous silicon TFTs for the active matrix pixels. As a result of this low mobility, amorphous silicon cannot be used to implement PMOS TFTs. The use of NMOS only transistors within the pixel circuit thus limits the use of amorphous silicon.

The development of TFT array technologies has been driven by the widespread use of such arrays in liquid crystal displays. Indeed, there has been much interest in improving arrays of thin film transistors (TFTs) which are used to form the switching elements for flat panel liquid crystal displays.

Hydrogenated amorphous silicon is currently used as the active layer in thin film transistors (TFTs) for active matrix liquid crystal displays. This is because it can be deposited in thin, uniform layers over large areas by plasma enhanced chemical vapour deposition (PECVD). However, the very low carrier mobility mentioned above reduces the switching speed of devices and prevents the use of these transistors in display driver circuitry. Amorphous silicon TFTs are also relatively unstable and are useful for display applications only because the duty cycle is relatively low.

Crystalline silicon is required for the higher speed driver circuitry, which necessitates both a driving circuit panel and a display panel within a display device, with interconnections between these two circuit types.

Microcrystalline silicon TFTs have been suggested as a suitable technology both for liquid crystal driver circuitry and for the pixel transistors. This proposal is driven by the desire to integrate the driver circuitry onto the same substrate as the active plate of the liquid crystal display. However, it is also not possible to form suitable PMOS TFTs from microcrystalline silicon, so that the same limitations apply in the design of pixel circuits.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO 96/36959 can also be used.

FIG. 2 shows in simplified schematic form a known pixel and drive circuitry arrangement. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel.

Replacing the drive transistor 22 with an NMOS device (which would be required to enable an amorphous silicon or microcrystalline silicon implementation) does not provide correct operation of the pixel circuit, as the gate-source voltage then depends upon the anode voltage of the display element 2 (which is connected to the NMOS TFT source). The capacitor therefore does not hold the gate-source voltage constant, as required. Furthermore, it is desirable to maintain the circuitry on the anode side of the LED, because it is difficult to pattern the cathode metal. so that it is not appropriate simply to invert the circuit to allow the drive transistor to be implemented as an NMOS device.

According to the invention, there is provided an active matrix electroluminescent display device comprising an array of display pixels, each pixel comprising:

an electroluminescent display element;

an amorphous silicon or microcrystalline silicon first drive NMOS transistor connected between the anode of the display element and a power supply line;

a storage capacitor between the anode of the display element and the gate of the drive transistor; and an amorphous silicon or microcrystalline silicon second drive NMOS transistor for supplying a holding voltage to the anode of the display element.

This arrangement enables the voltage across the display element to be held while the transistor gate drive voltage is stored on the storage capacitor. As the drive transistor is an NMOS device, the source is connected to the anode of the display element, so that this arrangement has the effect of holding the transistor source voltage to a known level while the drive voltage is stored on the storage capacitor. This enables an accurate current source pixel circuit to be implemented using NMOS transistors.

The second drive transistor is preferably connected between the power supply line and the anode of the display element. In this way, the power supply line can supply both the holding voltage and the drive voltage for driving the display element.

Alternatively, the second drive transistor can be connected between a second power supply line and the anode of the display element. This second power supply line can be shared between pixels in a row of the array.

The gate of the first drive transistor may be coupled to a data signal line, for example a column conductor, through an address transistor driven by a row conductor. A pixel drive signal is thus coupled to the pixel in known manner.

The first and second drive transistors (and all other transistors in the circuit) are preferably microcrystalline silicon TFTs comprising silicon crystallites of size 40 nm-140 nm in an amorphous silicon matrix. These transistors have improved carrier mobility and yet can still be deposited using a PECVD process. If the crystallites are large enough, then extended state conduction is enhanced and the mobility increased, approximately by a factor of 10 compared to amorphous silicon layers.

The invention also provides a method of driving the pixels of an active matrix electroluminescent display device comprising an array of display pixels each having an electroluminescent display element, the method comprising:

holding the voltage across the display element by applying a holding voltage through a first amorphous silicon or microcrystalline silicon NMOS transistor, the holding voltage holding the source voltage of a second amorphous silicon or microcrystalline silicon NMOS transistor;

while holding the voltage across the display element, storing a desired gate-source voltage on a storage capacitor connected between the gate and source of the second transistor, the gate-source voltage corresponding to a desired source-drain current for driving the display element;

removing the holding voltage from the display element; and driving the desired source-drain current through the electroluminescent display element.

In this method, a holding voltage is applied to the so that the source of the drive transistor is held at a fixed potential, so that a desired gate-source voltage can be accurately stored on a storage capacitor. The desired source-drain current is then driven through the second transistor by applying a first power supply voltage to the second transistor.

The invention will now be described by way of example with reference to the accompanying drawings, in which.

Figure 1:
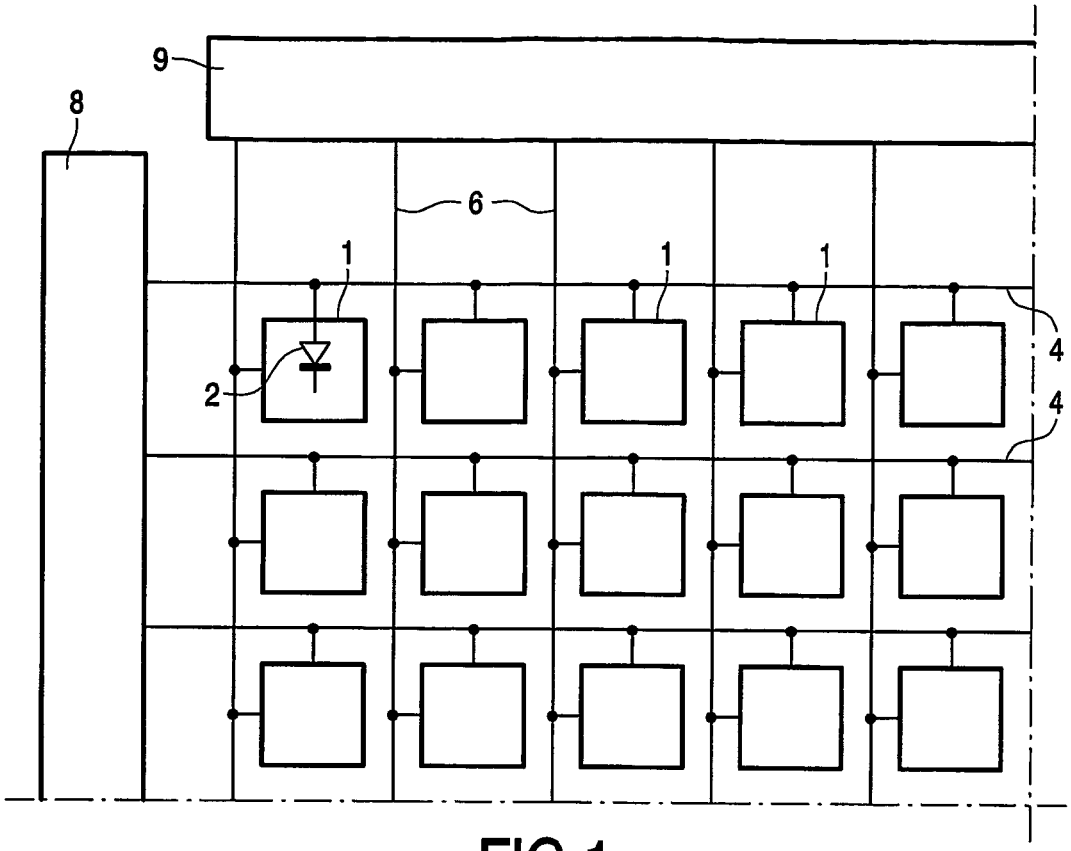
FIG. 1 shows a known EL display device.

It should be noted that these figures are diagrammatic and not drawn to scale. Relative dimensions and proportions of parts of these figures have been shown exaggerated or reduced in size, for the sake of clarity and convenience in the drawings.

In accordance with the invention, amorphous or microcrystalline silicon transistors are used within the pixel structure. This requires the TFTs to be NMOS devices, as explained above.

Figure 2:
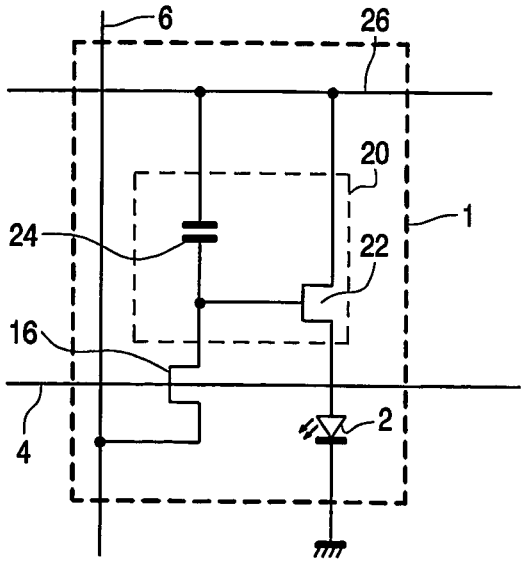
FIG. 2 is a simplified schematic diagram of a known pixel circuit for current-addressing the EL display pixel.
Figure 3:
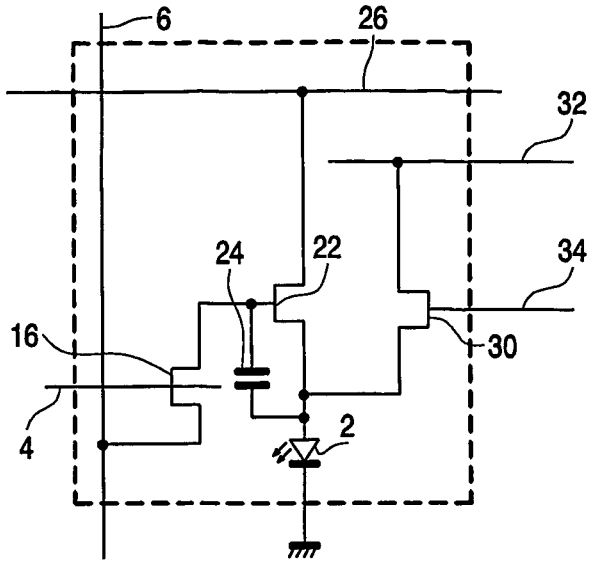
FIG. 3 shows a first example of pixel circuit according to the invention.

FIG. 3 shows a first example of pixel layout of the invention. The same reference numerals are used to denote the same components as in FIG. 2, and the pixel circuit is for use in a display such as shown in FIG. 1.

In the pixel arrangement of the invention, the drive transistor 22 is implemented as an amorphous silicon or microcrystalline silicon NMOS TFT. The pixel circuitry is provided on a substrate on the anode side of the EL display element 2, and the source of the NMOS drive transistor is thus in electrical contact with anode of the EL display element.

The storage capacitor 24 is provided between the anode of the display element 2 and the gate of the drive transistor 22 and is thereby charged to the gate-source voltage of the drive transistor 22 when it is addressed. As the source is connected to the EL display element, which will not have a constant voltage drop across it, the potential of the source may vary so that a given voltage from the column conductor 6 will not necessarily result in the same gate-source voltage stored on the storage capacitor 24. To ensure that a voltage on the column conductor has a known one-to-one relationship with the resulting gate-source voltage, it is necessary to hold the voltage of the EL display element anode.

To achieve this, the pixel circuit of the invention includes a second drive NMOS transistor 30 for supplying a holding voltage to the anode of the display element 2. This holding voltage is supplied when the gate-source voltage is being transferred to the storage capacitor 24.

In the example of FIG. 3, the second drive transistor 30 is connected between a second power supply line 32 and the anode of the display element 2. The second power supply line 32 is shared between pixels in a row of the array, and the second drive transistor is controlled by a gate line 34 which is also shared between pixels in a row. This arrangement thus requires two additional row conductors, in addition to the row conductor 4.

During an addressing phase, the second drive transistor 30 is turned on to hold the anode of the EL display element to the voltage on the second power supply line (less any source-drain voltage drop). The signal data voltage on the column conductor 6 then charges the storage capacitor 24 to a known gate-source voltage which corresponds to the desired source-drain current of the first drive transistor 22, which in turn corresponds to the desired level of illumination of the EL display element 2. At the end of the addressing phase, the row conductor 4 is brought low to turn off the address transistor 16, and subsequently the gate line 34 is brought low, thereby allowing potential on the EL display element anode to vary. As this potential varies, the gate voltage varies as the gate-source voltage is preserved by the storage capacitor 24.

This circuit requires the transistor 30 to be large so that all current from the drive transistor 22 can be directed to the second power supply line 32 without any voltage drop. A large additional transistor can use pixel aperture, and FIG. 4 shows an alternative pixel configuration to avoid the need for the second drive transistor 30 to pass large currents.

Figure 4:
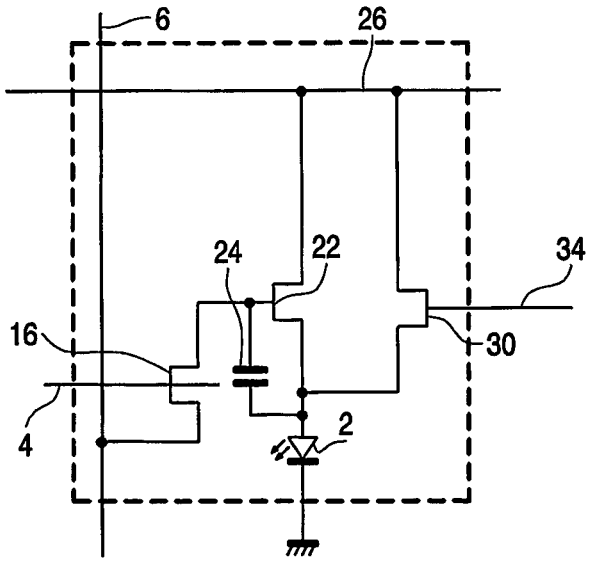
FIG. 4 shows a second example of pixel circuit according to the invention.

In FIG. 4, the second drive transistor 30 is connected between the (only) power supply line 26 and the anode of the display element 2. This reduces the current requirements of the second drive transistor 30.

In an addressing phase of this pixel circuit, the power supply line 26 is held at a low potential so that the first drive transistor 22 does not conduct. Thus, the second drive transistor 30 is required only to discharge any residual charge on the EL display element 2 and to provide a charging path for the storage capacitor 24. The power supply line 26 is held low while all pixels are addressed. When addressing is finished, all address lines (row conductor 4 and gate lines 34) are brought low and the power supply line 26 is then brought high so that the LEDs light up. The flashing of the power supply line 26 will have the advantage of reduced sample and hold for motion blur reduction.

In this circuit, the row conductors 4 and the gate lines 34 may be connected together so that no increase in the number of row conductors is required. The power supply line 26 can be modulated on a row-by-row basis or on an image-by-image basis.

In the two circuits above, all transistors are NMOS transistors, which may be formed from amorphous silicon. However, a preferred technology is microcrystalline silicon TFTs. These comprise silicon crystallites of size 40 nm-140 nm in an amorphous silicon matrix. The EL display element may be any known organic EL display element, including polymer EL display elements.

These pixel layouts are addressed using a method by which a voltage across the display element is held during an addressing phase, which in turn holds the source voltage of the drive transistor. While this source voltage is held, a desired gate-source voltage is stored on the storage capacitor corresponding to a desired source-drain current for driving the display element. The holding voltage is then removed from the display element and the desired source-drain current is driven through the electroluminescent display element.

Whilst two examples of circuits have been given showing how the invention can be implemented, various other possibilities exist and are intended to fall within the scope of the claims. The various modifications will be apparent to those skilled in the art.

The invention claimed is:

1. An active matrix electroluminescent display device comprising an array of display pixels, each pixel comprising:

an electroluminescent display element;

an amorphous silicon or microcrystalline silicon first drive NMOS transistor having a source directly connected to the anode of the display element and having a drain connected to a power supply line;

a storage capacitor between the anode of the display element and a gate of the first drive transistor; and an amorphous silicon or microcrystalline silicon second drive NMOS transistor having a source directly connected to the anode of the display element and having a drain directly connected to a holding voltage for supplying the holding voltage, minus a drain to source voltage drop across the second drive transistor, to the anode of the display element, wherein when the holding voltage is supplied to the anode of the display element, a gate-source voltage, for the first drive transistor, is stored on the storage capacitor.

2. The device as claimed in claim 1, wherein the holding voltage is provided by the power supply line.

3. The device as claimed in claim 1, wherein the power supply line is a first power supply line and the holding voltage is provided by a second power supply line that is separate from the first power supply line.

4. The device as claimed in claim 3, wherein the second power supply line is shared between pixels in a row of the array.

5. The device as claimed in any one of claims 1 to 4, wherein the gate of the first drive transistor is coupled to a data signal line through an address transistor.

6. The device as claimed in claim 1, wherein the gate of the first drive transistor is coupled to a data signal line through an address transistor, and wherein the data signal line comprises a column conductor shared between pixels in a column of the array.

7. The device as claimed in claim 6, wherein the gate of the address transistor is coupled to a row conductor shared between pixels in a row of the array.

8. The device as claimed in claim 1, wherein the first and second drive transistors comprise microcrystalline silicon TFTs comprising silicon crystallites of size 40 nm-140 nm in an amorphous silicon matrix.

9. A method of driving the pixels of an active matrix electroluminescent display device comprising an array of display pixels each having an electroluminescent display element, the method comprising:

holding the voltage across the display element by applying a holding voltage through a second amorphous silicon or microcrystalline silicon NMOS transistor having a source directly connected to an anode of the electroluminescent display element and having a drain directly connected to the holding voltage, the holding voltage holding a source voltage of a first amorphous silicon or microcrystalline silicon NMOS transistor that is directly connected to the anode of the electroluminescent display element;

while holding the first voltage across the display element, storing a desired gate-source voltage, for the first transistor, on a storage capacitor connected between the gate and source of the first transistor, the gate-source voltage corresponding to a desired source-drain current for driving the display element;

removing the first voltage from the display element; and driving the desired source-drain current through the electroluminescent display element.

10. The method as claimed in claim 9, wherein the desired source-drain current is driven through the second transistor by applying a first power supply voltage to the second transistor.

11. The method as claimed in claim 10, wherein the first power supply voltage is not applied to the second transistor while the first voltage across the display is held.

12. The method as claimed in claim 11, wherein the first power supply voltage and the holding voltage are provided by a shared power supply line.

13. The method as claimed in any one of claims 9 to 12, wherein storing a desired gate-source voltage on a storage capacitor comprises coupling data from a data signal line to the storage capacitor through an address transistor.

14. An active matrix electroluminescent display device comprising an array of display pixels, each pixel comprising:

an electroluminescent display element;

an amorphous silicon or microcrystalline silicon first drive NMOS transistor having a source directly connected to the anode of the display element and having a drain connected to a power supply line;

a storage capacitor between the anode of the display element and the gate of the first drive transistor; and an amorphous silicon or microcrystalline silicon second drive NMOS transistor having a source directly connected to the anode of the display element and having a drain directly connected to a holding voltage for supplying the holding voltage, minus a drain to source voltage drop across the second drive transistor, to the anode of the display element, wherein the gate of the first drive transistor is coupled to a data signal line through an address transistor, and wherein the first and second drive transistors comprise microcrystalline silicon TFTs comprising silicon crystallites of size 40 nm-140 nm in an amorphous silicon matrix, wherein when the holding voltage is supplied to the anode of the display element, a gate-source voltage, for the first drive transistor, is stored on the storage capacitor.

15. The device as claimed in claim 1, wherein a cathode of the electroluminescent display element is directly connected to ground.

16. The method as claimed in claim 9, wherein a cathode of the electroluminescent display element is directly connected to ground.

* * * * *